US007357181B2

(12) United States Patent
Webb et al.

(10) Patent No.: US 7,357,181 B2
(45) Date of Patent: Apr. 15, 2008

(54) APPARATUS FOR AUTOFILL DEACTIVATION OF FLOAT EQUIPMENT AND METHOD OF REVERSE CEMENTING

(75) Inventors: Earl D. Webb, Wilson, OK (US); Henry E. Rogers, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 241 days.

(21) Appl. No.: 11/230,807

(22) Filed: Sep. 20, 2005

(65) Prior Publication Data

US 2007/0062700 A1 Mar. 22, 2007

(51) Int. Cl.
*E21B 33/14* (2006.01)

(52) U.S. Cl. ..... 166/285; 166/177.4; 166/327; 166/318; 166/332.8; 166/332.4

(58) Field of Classification Search ..... 166/285, 166/177.4, 327, 318, 332.8, 332.4
See application file for complete search history.

(56) References Cited

U.S. PATENT DOCUMENTS

| | | | |
|---|---|---|---|
| 2,223,509 | A | 12/1940 | Brauer |
| 2,230,589 | A | 2/1941 | Driscoll |
| 2,407,010 | A | 9/1946 | Hudson |
| 2,472,466 | A | 6/1949 | Counts et al. |
| 2,647,727 | A | 8/1953 | Edwards |
| 2,675,082 | A | 4/1954 | Hall |
| 2,849,213 | A | 8/1958 | Failing |
| 2,919,709 | A | 1/1960 | Schwegman |
| 3,051,246 | A | 8/1962 | Clark, Jr. et al. |
| 3,193,010 | A | 7/1965 | Bielstien |
| 3,277,962 | A | 10/1966 | Flickinger et al. |
| 3,570,596 | A | 3/1971 | Young |
| 3,624,018 | A | 11/1971 | Eilers et al. |
| 3,653,441 | A | 4/1972 | Tuttle |
| 3,948,322 | A | 4/1976 | Baker |
| 3,948,588 | A | 4/1976 | Curington et al. |
| 3,951,208 | A | 4/1976 | Delano |
| 4,105,069 | A | 8/1978 | Baker |
| 4,271,916 | A | 6/1981 | Williams |

(Continued)

FOREIGN PATENT DOCUMENTS

EP 0 419 281 A2 3/1991

(Continued)

OTHER PUBLICATIONS

Foreign communication from a related counterpart application, Feb. 27, 2007.

(Continued)

*Primary Examiner*—Jennifer H. Gay
*Assistant Examiner*—Robert E Fuller
(74) *Attorney, Agent, or Firm*—John W. Wustenberg; Baker Botts, L.L.P.

(57) ABSTRACT

A method for cementing a casing in a wellbore, the method having the following steps: attaching a valve to a casing; locking the valve in an open configuration; running the casing and the valve into the wellbore; reverse circulating a cement composition down an annulus defined between the casing and the wellbore; injecting a plurality of plugs into the annulus; unlocking the valve with the plurality of plugs; and closing the valve.

13 Claims, 9 Drawing Sheets

U.S. PATENT DOCUMENTS

| | | | | |
|---|---|---|---|---|
| 4,300,633 | A | 11/1981 | Stewart | |
| 4,304,298 | A | 12/1981 | Sutton | |
| 4,340,427 | A | 7/1982 | Sutton | |
| 4,367,093 | A | 1/1983 | Burkhalter et al. | |
| RE31,190 | E | 3/1983 | Detroit et al. | |
| 4,450,010 | A | 5/1984 | Burkhalter et al. | |
| 4,457,379 | A | 7/1984 | McStravick | |
| 4,466,833 | A | 8/1984 | Spangle | |
| 4,469,174 | A | 9/1984 | Freeman | |
| 4,519,452 | A | 5/1985 | Tsao et al. | |
| 4,531,583 | A | 7/1985 | Revett | |
| 4,548,271 | A | 10/1985 | Keller | |
| 4,555,269 | A | 11/1985 | Rao et al. | |
| 4,565,578 | A | 1/1986 | Sutton et al. | |
| 4,671,356 | A | 6/1987 | Barker et al. | |
| 4,676,832 | A | 6/1987 | Childs et al. | |
| 4,729,432 | A | 3/1988 | Helms | |
| 4,791,988 | A | 12/1988 | Trevillion | |
| 4,961,465 | A | 10/1990 | Brandell | |
| 5,024,273 | A | 6/1991 | Coone et al. | |
| 5,117,910 | A | 6/1992 | Brandell et al. | |
| 5,125,455 | A | 6/1992 | Harris et al. | |
| 5,133,409 | A | 7/1992 | Bour et al. | |
| 5,147,565 | A | 9/1992 | Bour et al. | |
| 5,188,176 | A | 2/1993 | Carpenter | |
| 5,213,161 | A | 5/1993 | King et al. | |
| 5,273,112 | A | 12/1993 | Schultz | |
| 5,297,634 | A | 3/1994 | Loughlin | |
| 5,318,118 | A | 6/1994 | Duell | |
| 5,323,858 | A | 6/1994 | Jones et al. | |
| 5,361,842 | A | 11/1994 | Hale et al. | |
| 5,484,019 | A | 1/1996 | Griffith | |
| 5,494,107 | A | 2/1996 | Bode | 166/285 |
| 5,507,345 | A | 4/1996 | Wehunt, Jr. et al. | |
| 5,559,086 | A | 9/1996 | Dewprashad et al. | |
| 5,571,281 | A | 11/1996 | Allen | |
| 5,577,865 | A | 11/1996 | Manrique et al. | |
| 5,641,021 | A | 6/1997 | Murray et al. | |
| 5,647,434 | A | 7/1997 | Sullaway et al. | |
| 5,671,809 | A | 9/1997 | McKinzie | |
| 5,718,292 | A | 2/1998 | Heathman et al. | |
| 5,738,171 | A | 4/1998 | Szarka | |
| 5,749,418 | A | 5/1998 | Mehta et al. | |
| 5,762,139 | A | 6/1998 | Sullaway et al. | |
| 5,803,168 | A | 9/1998 | Lormand et al. | |
| 5,829,526 | A | 11/1998 | Rogers et al. | |
| 5,875,844 | A | 3/1999 | Chatterji et al. | |
| 5,890,538 | A | 4/1999 | Beirute et al. | |
| 5,897,699 | A | 4/1999 | Chatterji et al. | |
| 5,900,053 | A | 5/1999 | Brothers et al. | |
| 5,913,364 | A | 6/1999 | Sweatman | |
| 5,968,255 | A | 10/1999 | Mehta et al. | |
| 5,972,103 | A | 10/1999 | Mehta et al. | |
| 6,060,434 | A | 5/2000 | Sweatman et al. | |
| 6,063,738 | A | 5/2000 | Chatterji et al. | |
| 6,098,710 | A | 8/2000 | Rhein-Knudsen et al. | |
| 6,138,759 | A | 10/2000 | Chatterji et al. | |
| 6,143,069 | A | 11/2000 | Brothers et al. | |
| 6,167,967 | B1 | 1/2001 | Sweatman | |
| 6,196,311 | B1 | 3/2001 | Treece et al. | |
| 6,204,214 | B1 | 3/2001 | Singh et al. | |
| 6,244,342 | B1 | 6/2001 | Sullaway et al. | |
| 6,258,757 | B1 | 7/2001 | Sweatman et al. | |
| 6,311,775 | B1 | 11/2001 | Allamon et al. | |
| 6,318,472 | B1 | 11/2001 | Rogers et al. | |
| 6,367,550 | B1 | 4/2002 | Chatterji et al. | |
| 6,431,282 | B1 | 8/2002 | Bosma et al. | |
| 6,454,001 | B1 | 9/2002 | Thompson et al. | |
| 6,457,524 | B1 | 10/2002 | Roddy | |
| 6,467,546 | B2 | 10/2002 | Allamon et al. | |
| 6,481,494 | B1 | 11/2002 | Dusterhoft et al. | |
| 6,484,804 | B2 | 11/2002 | Allamon et al. | |
| 6,488,088 | B1 | 12/2002 | Kohli et al. | |
| 6,488,089 | B1 | 12/2002 | Bour et al. | |
| 6,488,763 | B2 | 12/2002 | Brothers et al. | |
| 6,540,022 | B2 | 4/2003 | Dusterhoft et al. | |
| 6,622,798 | B1 | 9/2003 | Rogers et al. | |
| 6,666,266 | B2 | 12/2003 | Starr et al. | |
| 6,679,336 | B2 | 1/2004 | Musselwhite et al. | |
| 6,715,553 | B2 | 4/2004 | Reddy et al. | |
| 6,722,434 | B2 | 4/2004 | Reddy et al. | |
| 6,725,935 | B2 | 4/2004 | Szarka et al. | |
| 6,732,797 | B1 | 5/2004 | Watters et al. | 166/291 |
| 6,758,281 | B2 | 7/2004 | Sullaway et al. | |
| 6,802,374 | B2 | 10/2004 | Edgar et al. | |
| 6,808,024 | B2 | 10/2004 | Schwendemann et al. | |
| 6,810,958 | B2 | 11/2004 | Szarka et al. | |
| 2002/0148614 | A1 | 10/2002 | Szarka | |
| 2003/0000704 | A1 | 1/2003 | Reynolds | |
| 2003/0029611 | A1 | 2/2003 | Owens | |
| 2003/0072208 | A1 | 4/2003 | Rondeau et al. | |
| 2003/0192695 | A1 | 10/2003 | Dillenbeck et al. | |
| 2004/0060700 | A1* | 4/2004 | Vert et al. | 166/291 |
| 2004/0079553 | A1 | 4/2004 | Livingstone | |
| 2004/0084182 | A1 | 5/2004 | Edgar et al. | |
| 2004/0099413 | A1 | 5/2004 | Arceneaux | |
| 2004/0104050 | A1 | 6/2004 | Järvelä et al. | |
| 2004/0104052 | A1 | 6/2004 | Livingstone | |
| 2004/0177962 | A1 | 9/2004 | Bour | |
| 2004/0231846 | A1 | 11/2004 | Griffith et al. | 166/291 |
| 2005/0061546 | A1 | 3/2005 | Hannegan | |
| 2006/0016599 | A1 | 1/2006 | Badalamenti et al. | |
| 2006/0016600 | A1 | 1/2006 | Badalamenti et al. | |
| 2006/0042798 | A1 | 3/2006 | Badalamenti et al. | |
| 2006/0086499 | A1 | 4/2006 | Badalamenti et al. | |
| 2006/0086502 | A1 | 4/2006 | Reddy et al. | |
| 2006/0086503 | A1 | 4/2006 | Reddy et al. | |
| 2006/0102338 | A1* | 5/2006 | Angman et al. | 166/177.4 |
| 2006/0131018 | A1 | 6/2006 | Rogers et al. | |
| 2007/0095533 | A1* | 5/2007 | Rogers et al. | 166/285 |

FOREIGN PATENT DOCUMENTS

| | | | |
|---|---|---|---|
| GB | 2193741 | | 2/1988 |
| GB | 2327442 | A | 11/1999 |
| GB | 2 327 442 | | 10/2000 |
| GB | 2 348 828 | | 10/2000 |
| GB | 2348828 | A | 10/2000 |
| RU | 1774986 | | 11/1992 |
| RU | 1778274 | | 11/1992 |
| RU | 1 542 143 | | 12/1994 |
| RU | 1542143 | C | 12/1994 |
| RU | 2067158 | | 9/1996 |
| RU | 2 086 752 | | 8/1997 |
| RU | 2 086 752 | C1 | 8/1997 |
| SU | 571584 | | 9/1977 |
| SU | 1420139 | A1 | 8/1988 |
| SU | 1534183 | | 1/1990 |
| SU | 1716096 | A1 | 2/1992 |
| SU | 1723309 | A1 | 3/1992 |
| SU | 1758211 | A1 | 8/1992 |
| WO | SU 1716096 | A1 | 2/1992 |
| WO | WO 2004/104366 | | 12/2004 |
| WO | WO 2005/083229 | A | 9/2005 |
| WO | WO 2005/083229 | A1 | 9/2005 |
| WO | WO 2006/008490 | A1 | 1/2006 |
| WO | WO 2006/064184 | A1 | 6/2006 |

OTHER PUBLICATIONS

Foreign communication from a related counterpart application, Jan. 8, 2007.

Foreign communication from a related counterpart application, Jan. 17, 2007.

Foreign Communication From a Related Counter Part Application, Jan. 8, 2007.
Foreign Communication From a Related Counter Part Application, Jan. 17, 2007.
Griffith, et al., "Reverse Circulation of Cement on Primary Jobs Increases Cement Column Height Across Weak Formations," Society of Petroleum Engineers, SPE 25440, 315-319, Mar. 22-23, 1993.
Filippov, et al., "Expandable Tubular Solutions," Society of Petroleum Engineers, SPE 56500, Oct. 3-6, 1999.
Daigle, et al., "Expandable Tubulars: Field Examples of Application in Well Construction and Remediation," Society of Petroleum Engineers, SPE 62958, Oct. 1-4, 2000.
Carpenter, et al., "Remediating Sustained Casing Pressure by Forming a Downhole Annular Seal With Low-Melt-Point Eutectic Metal," IADC/SPE 87198, Mar. 2-4, 2004.
Halliburton Casing Sales Manual, Section 4, Cementing Plugs, pp. 4-29 and 4-30, Oct. 6, 1993.
G.L. Cales, "The Development and Applications of Solid Expandable Tubular Technology," Paper No. 2003-136, Petroleum Society's Canadian International Petroleum Conference 2003, Jun. 10-12, 2003.
Gonzales, et al., "Increasing Effective Fracture Gradients by Managing Wellbore Temperatures," IADC/SPE 87217, Mar. 2-4, 2004.
Fryer, "Evaluation of the Effects of Multiples in Seismic Data From the Gulf Using Vertical Seismic Profiles," SPE 25540, 1993.
Griffith, "Monitoring Circulatable Hole With Real-Time Correction: Case Histories," SPE 29470, 1995.
Ravi, "Drill-Cutting Removal in a Horizontal Wellbore for Cementing," IADC/SPE 35081, 1996.
MacEachern, et al., "Advances in Tieback Cementing," IADC/SPE 79907, 2003.
Davies, et al, "Reverse Circulation of Primary Cementing Jobs—Evaluation and Case History," IADC/SPE 87197, Mar. 2-4, 2004.
Abstract No. XP-002283587, "Casing String Reverse Cemented Unit Enhance Efficiency Hollow Pusher Housing".
Abstract No. XP-002283586, "Reverse Cemented Casing String Reduce Effect Intermediate Layer Mix Cement Slurry Drill Mud Quality Lower Section Cement Lining".
Brochure, Enventure Global Technology, "Expandable-Tubular Technology," pp. 1-6, 1999.
Dupal, et al, "Solid Expandable Tubular Technology—A Year of Case Histories in the Drilling Environment," SPE/IADC 67770, Feb. 27-Mar. 1, 2001.
DeMong, et al., "Planning the Well Construction Process for the Use of Solid Expandable Casing," SPE/IADC 85303, Oct. 20-22, 2003.
Waddell, et al., "Installation of Solid Expandable Tubular Systems Through Milled Casing Windows," IADC/SPE 87208, Mar. 2-4, 2004.
DeMong, et al., "Breakthroughs Using Solid Expandable Tubulars to Construct Extended Reach Wells," IADC/SPE 87209, Mar. 2-4, 2004.
Escobar, et al., "Increasing Solid Expandable Tubular Technology Reliability in a Myriad of Downhole Environments," SPE 81094, Apr. 27-30, 2003.
Foreign Communication From a Related Counter Part Application, Oct. 12, 2005.
Foreign Communication From a Related Counter Part Application, Sep. 30, 2005.
Foreign Communication From a Related Counter Part Application, Dec. 7, 2005.
Halliburton Brochure Entitled "Bentonite (Halliburton Gel) Viscosifier", 1999.
Halliburton Brochure Entitled "Cal-Seal 60 Cement Accelerator", 1999.
Halliburton Brochure Entitled "Diacel D Lightweight Cement Additive", 1999.
Halliburton Brochure Entitled "Cementing Flex-Plug® OBM Lost-Circulation Material", 2004.
Halliburton Brochure Entitled "Cementing FlexPlug® W Lost-Circulation Material", 2004.
Halliburton Brochure Entitled "Gilsonite Lost-Circulation Additive", 1999.
Halliburton Brochure Entitled "Micro Fly Ash Cement Component", 1999.
Halliburton Brochure Entitled "Silicalite Cement Additive", 1999.
Halliburton Brochure Entitled "Spherelite Cement Additive", 1999.
Halliburton Brochure Entitled "Increased Integrity With the Stratalock Stabilization System", 1998.
Halliburton Brochure Entitled "Perlite Cement Additive", 1999.
Halliburton Brochure Entitled "The PermSeal System Versatile, Cost-Effective Sealants for Conformance Applications", 2002.
Halliburton Brochure Entitled "Pozmix® a Cement Additive", 1999.
Foreign Communication From a Related Counter Part Application, Dec. 9, 2005.
Foreign Communication From a Related Counter Part Application, Feb. 24, 2005.
R. Marquaire et al., "Primary Cementing by Reverse Circulation Solves Critical Problem in the North Hassi-Messaoud Field, Algeria", SPE 1111, Feb. 1966.
Foreign Communication From a Related Counter Part Application, Dec. 27, 2005.
Foreign Communication From a Related Counter Part Application, Feb. 23, 2006.
SPE 25540 entitled "Evaluation of the Effects of Multiples In Seismic Data From the Gulf Using Vertical Seismic Profiles" by Andrew Fryer, dated 1993.
SPE 29470 entitled "Monitoring Circulatable Hole with Real-Time Correction: Case Histories" by James E. Griffith, dated 1995.
IADC/SPE 35081 entitled "Drill-Cutting Removal in a Horizontal Wellbore for Cementing" by Krishna M. Ravi, dated 1996.
SPE/IADC 79907 entitled "Advances in Tieback Cementing" by Douglas P. MacEachern et al., dated 2003.
SPE 87197 entitled "Reverse Circulation of Primary Cementing Jobs-Evaluation and Case History" by J. Davies, et al., dated Mar. 2, 2004.

* cited by examiner

APPARATUS FOR AUTOFILL DEACTIVATION OF FLOAT EQUIPMENT AND METHOD OF REVERSE CEMENTING

BACKGROUND

This invention relates to reverse cementing operations. In particular, this invention relates to methods and apparatuses for floating the casing and controlling fluid flow through the casing shoe.

After a well for the production of oil and/or gas has been drilled, casing may be run into the wellbore and cemented. In conventional cementing operations, a cement composition is displaced down the inner diameter of the casing. The cement composition is displaced downwardly into the casing until it exits the bottom of the casing into the annular space between the outer diameter of the casing and the wellbore. It is then pumped up the annulus until a desired portion of the annulus is filled.

The casing may also be cemented into a wellbore by utilizing what is known as a reverse-cementing method. The reverse-cementing method comprises displacing a cement composition into the annulus at the surface. As the cement is pumped down the annulus, drilling fluids ahead of the cement composition around the lower end of the casing string are displaced up the inner diameter of the casing string and out at the surface. The fluids ahead of the cement composition may also be displaced upwardly through a work string that has been run into the inner diameter of the casing string and sealed off at its lower end. Because the work string by definition has a smaller inner diameter, fluid velocities in a work string configuration may be higher and may more efficiently transfer the cuttings washed out of the annulus during cementing operations.

The reverse circulation cementing process, as opposed to the conventional method, may provide a number of advantages. For example, cementing pressures may be much lower than those experienced with conventional methods. Cement composition introduced in the annulus falls down the annulus so as to produce little or no pressure on the formation. Fluids in the wellbore ahead of the cement composition may be bled off through the casing at the surface. When the reverse-circulating method is used, less fluid may be handled at the surface and cement retarders may be utilized more efficiently.

In reverse circulation methods, it may be desirable to stop the flow of the cement composition when the leading edge of the cement composition slurry is at or just inside the casing shoe. To know when to cease the reverse circulation fluid flow, the leading edge of the slurry is typically monitored to determine when it arrives at the casing shoe. Logging tools and tagged fluids (by density and/or radioactive sources) have been used monitor the position of the leading edge of the cement slurry. If significant volumes of the cement slurry enters the casing shoe, clean-out operations may need to be conducted to insure that cement inside the casing has not covered targeted production zones. Position information provided by tagged fluids is typically available to the operator only after a considerable delay. Thus, even with tagged fluids, the operator is unable to stop the flow of the cement slurry into the casing through the casing shoe until a significant volume of cement has entered the casing. Imprecise monitoring of the position of the leading edge of the cement slurry can result in a column of cement in the casing 100 feet to 500 feet long. This unwanted cement may then be drilled out of the casing at a significant cost.

SUMMARY

This invention relates to reverse cementing operations. In particular, this invention relates to methods and apparatuses for floating the casing and controlling fluid flow through the casing shoe.

According to one aspect of the invention, there is provided a method for cementing a casing in a wellbore, the method having the following steps: attaching a valve to a casing; locking the valve in an open configuration; running the casing and the valve into the wellbore; reverse circulating a cement composition down an annulus defined between the casing and the wellbore; injecting a plurality of plugs into the annulus; unlocking the valve with the plurality of plugs; and closing the valve.

A further aspect of the invention provides a valve having a variety of components including: a valve housing defining a valve seat; a closure element adjustably connected to the valve housing, wherein the closure element is configurable relative to the valve seat in open and closed configurations; a lock in mechanical communication with the closure element to lock the closure element in the open configuration when the lock is assembled in the valve housing, wherein the lock comprises a strainer; and a bias element in mechanical communication with the valve housing and the closure element, wherein the bias element biases the closure element to the closed configuration.

Another aspect of the invention provides a system for reverse-circulation cementing a casing in a wellbore, wherein the system has a valve with a hole and a plurality of plugs, wherein the plugs have a plug dimension larger than the hole dimension. The valve may have a valve housing defining a valve seat; a closure element adjustably connected to the valve housing, wherein the closure element is configurable relative to the valve seat in open and closed configurations; a lock in mechanical communication with the closure element to lock the closure element in the open configuration when the lock is assembled in the valve housing, wherein the lock comprises a strainer with holes comprising a hole dimension; and a bias element in mechanical communication with the valve housing and the closure element, wherein the bias element biases the closure element to the closed configuration.

The objects, features, and advantages of the present invention will be readily apparent to those skilled in the art upon a reading of the description of the exemplary embodiments which follows.

BRIEF DESCRIPTION OF THE FIGURES

The present invention may be better understood by reading the following description of non-limitative embodiments with reference to the attached drawings wherein like parts of each of the several figures are identified by the same referenced characters, and which are briefly described as follows.

It is to be noted, however, that the appended drawings illustrate only typical embodiments of this invention and are therefore not to be considered limiting of its scope, as the invention may admit to other equally effective embodiments.

DETAILED DESCRIPTION

This invention relates to reverse cementing operations. In particular, this invention relates to methods and apparatuses for floating the casing and controlling fluid flow through the casing shoe.

Figure 1:
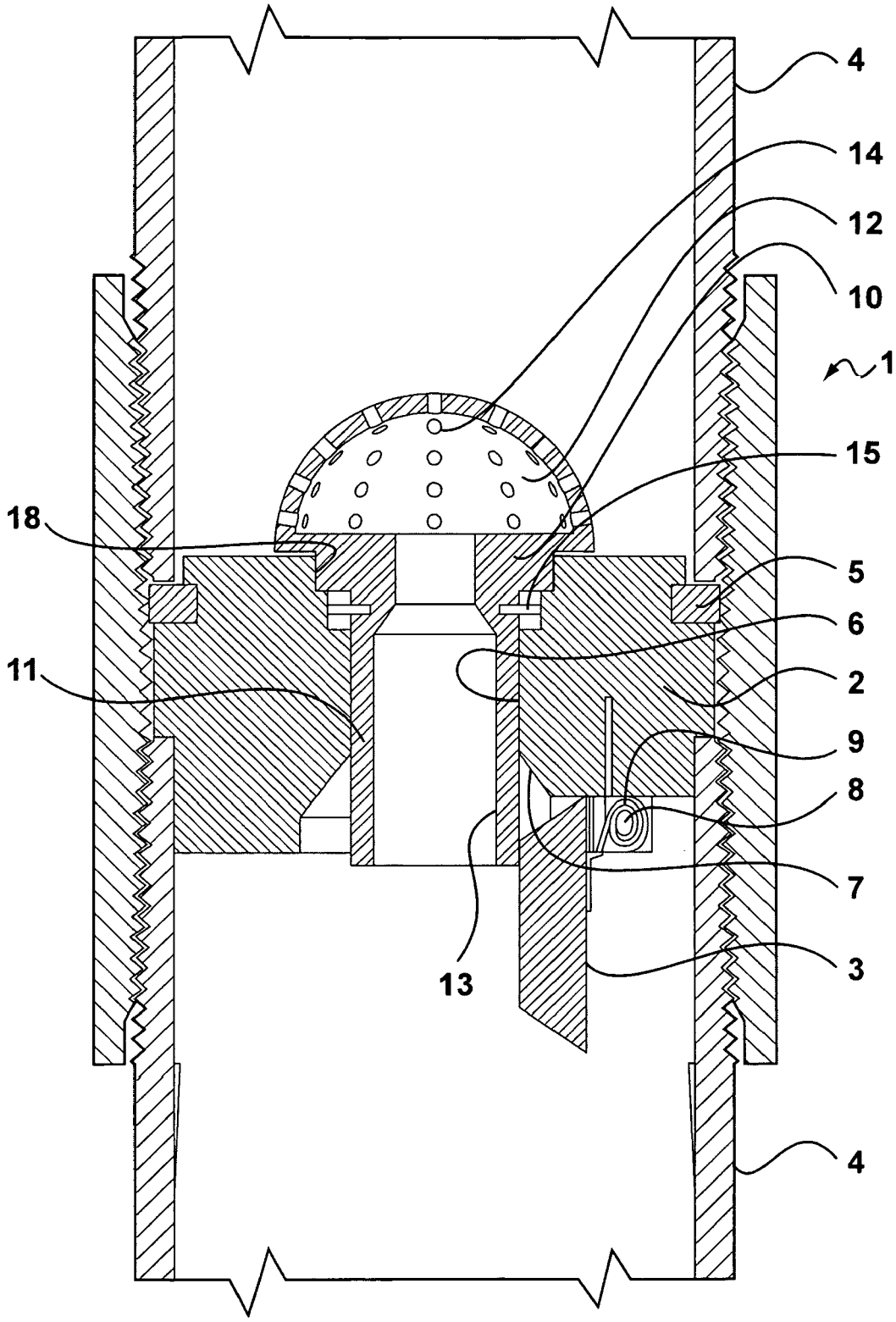
FIG. 1 is a cross-sectional, side view of a valve having a lock pin or orifice tube stung into a flapper seat to lock a flapper open.

Referring to FIG. 1, a cross-sectional side view of a valve is illustrated. This embodiment of the valve 1 has a flapper seat 2 and a flapper 3. The flapper seat 2 is a cylindrical structure that is positioned within the inner diameter of a casing 4. In particular, the flapper seat 2 may be assembled between 2 sections of the casing 4 as illustrated. A seal 5 closes the interface between the outer diameter of the flapper seat 2 and the inner diameter of the casing 4. The flapper seat 2 has an inner bore 6 for passing fluid through the flapper seat 2. At the mouth of the inner bore 6, the flapper seat 2 has a conical lip 7 for receiving the flapper 3 when the flapper is in a closed position. The flapper 3 is connected to the flapper seat 2 by a hinge 8. A spring 9 is assembled at the hinge 8 to bias the flapper 3 toward a closed position in the conical lip 7 of the flapper seat 2.

The valve 1 also has a lock pin 10 stung into the inner bore 6 of the flapper seat 2. The lock pin 10 has a stinger section 11 and a strainer section 12. In the illustrated embodiment, the stinger section 11 has a cylindrical structure having an outside diameter only slightly smaller than the inside diameter of the inner bore 6 of the flapper seat 2. Along its longitudinal axis, the stinger section 11 has a flow conduit 13 extending all the way through the stinger section 11. The strainer section 12 is connected to one end of the stinger section 11. In this embodiment, the strainer section 12 has a hemisphere-shaped structure with a plurality of holes 14.

When the lock pin 10 is inserted into the flapper seat 2 of the valve 1, as illustrated in FIG. 1, the flapper 3 is locked in an open configuration. With the stinger section 11 fully inserted into the inner bore 6 of the flapper seat 2, the stinger section 11 extends from the inner bore 6 and beyond the conical lip 7 to hold the flapper 3 open. The lock pin 10 may be retained in the flapper seat 2 by a pin or pins 15.

Figure 2D:
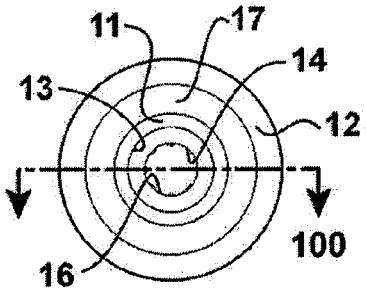
FIG. 2D is a bottom view from the stinger end of the lock pin of FIG. 2A.
Figure 2B:
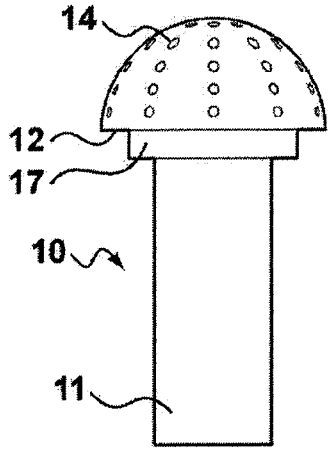
FIG. 2B is a side view of the lock pin of FIG. 2A.
Figure 2A:
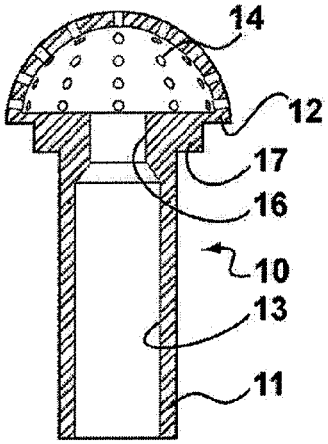
FIG. 2A is a cross-sectional, side view of a lock pin having a strainer section and a cylindrical stinger section.

FIG. 2A is a cross-sectional side view of a lock pin 10 of the present invention taken along plane 100 identified in FIG. 2D, discussed below. The lock pin 10 has a stinger section 11 connected to a strainer section 12. The stinger section 11 has a flow conduit 13 that extends the entire length of the stinger section 11. In this embodiment, the flow conduit 13 has a neck 16 where the flow conduit 13 opens into the interior of the strainer section 12. The strainer section is a dome with mushroom-shape such that the interior of the dome faces the open end of the flow conduit 13 at the neck 16. The strainer section 12 has a plurality of holes 14 that extend through its curved walls. In various embodiments of the lock pin 10, the cumulative flow area through the holes 14 is equal to or greater than the flow area through the flow conduit 13 and/or neck 16. A shoulder 17 extends radially outward between the stinger section 11 and the strainer section 12 so as to fit into a corresponding counter-bore 18 in the flapper seat 2 (see FIG. 1).

Figure 2C:
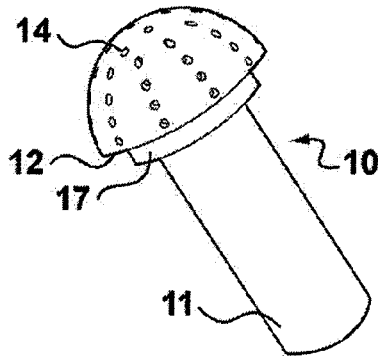
FIG. 2C is a perspective view of the lock pin of FIG. 2A.

FIGS. 2B and 2C illustrate side and perspective views, respectively, of the lock pin 10 of FIG. 2A. As noted previously, the lock pin 10 has a stinger section 11 and a strainer section 12, wherein the strainer section 12 has a plurality of holes 14 that extends through its walls. The holes 14 are arranged in a radial pattern around the curved walls of the strainer section 12. The shoulder 17 extends radially outward between the stinger section 11 and the strainer section 12.

FIG. 2D illustrates a bottom view from the stinger end of the lock pin 10 of FIGS. 2A through 2C. Concentric rings indicate wall surfaces of the various structures of the lock pin 10. The neck 16 has the smallest inner diameter followed by the flow conduit 13. The flow conduit 13, of course, is defined by the stinger section 11. The shoulder 17 extends between the outer rim of the strainer section 12 and the stinger section 11. Portions of the holes 14 are visible on the interior side of the strainer section 12 through the neck 16.

Figure 8D:
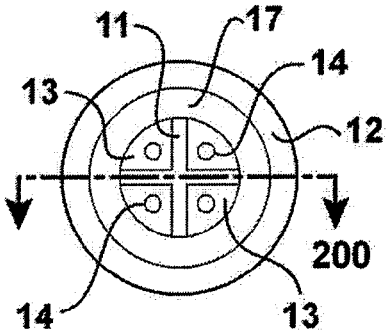
FIG. 8D is a bottom view from the stinger end of the lock pin of FIG. 8A.
Figure 8B:
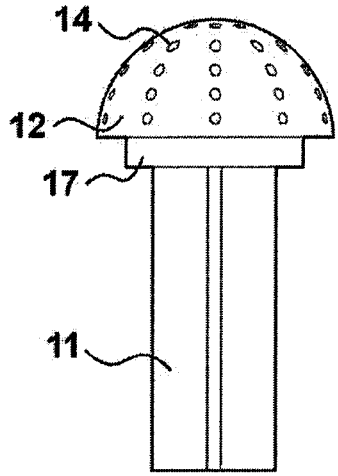
FIG. 8B is a side view of the lock pin of FIG. 8A.
Figure 8A:
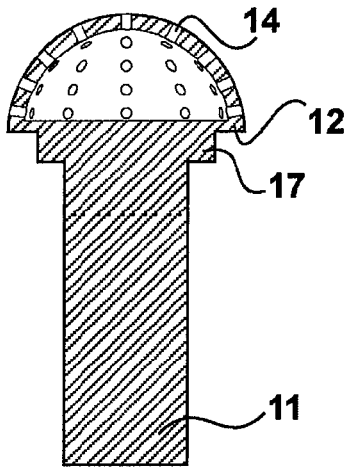
FIG. 8A is a cross-sectional, side view of a lock pin having a strainer section and a flanged stinger section.

FIG. 8A is a cross-sectional side view of an alternative lock pin 10 of the present invention taken along plane 200 identified in FIG. 8D, discussed below. The lock pin 10 has a stinger section 11 connected to a strainer section 12. The stinger section 11 has four flanges extending the entire length of the stinger section 11, wherein the flanges extend radially outwardly from a central axis where the flanges are connected. In this embodiment, the flow conduit 13 opens into the interior of the strainer section 12 through the shoulder 17 (see FIG. 8D). The flanges of the stinger section 11 extend into the flow conduit 13 so as to be connected to the interior surfaces of the flow conduit 13 at the four points where the flanges merge with the flow conduit 13. The strainer section 12 is a dome with mushroom-shape such that the interior of the dome faces the open end of the flow conduit 13. The strainer section 12 has a plurality of holes 14 that extend through its curved walls. The shoulder 17 extends radially outward between the stinger section 11 and the strainer section 12 so as to fit into a corresponding counter-bore 18 in the flapper seat 2 (see FIG. 1).

Figure 8C:
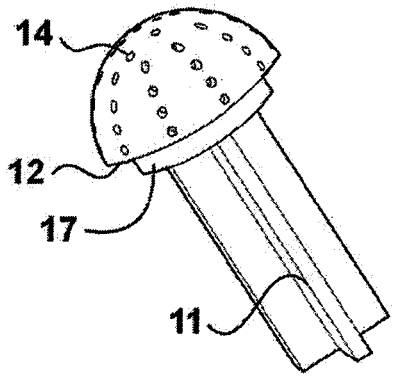
FIG. 8C is a perspective view of the lock pin of FIG. 8A.

FIGS. 8B and 8C illustrate side and perspective views, respectively, of the lock pin 10 of FIG. 8A. As noted previously, the lock pin 10 has a stinger section 11 and a strainer section 12, wherein the strainer section 12 has a plurality of holes 14 that extend through its walls. In FIG. 8B, two of the flanges extend to the left and the right from the center portion of the stinger section 11, while a third flange is shown extending out of the figure toward the viewer. Similarly, FIG. 8C illustrates two of the flanges extending mostly left and right, respective, while a third flange extends mostly toward the front. The fourth flange is hidden from view in the back.

FIG. 8D illustrates a bottom view from the stinger end of the lock pin 10 of FIGS. 8A through 8C. An outermost portion of the underside of the strainer section 12 is shown extending beyond the shoulder 17. The flow conduit 13 extends through the middle of the shoulder 17 and opens into the interior of the strainer section 12. The flanges of the stinger section 11 divide the flow conduit 13 into four pie-shaped sections. Some of the holes 14 are visible from within the strainer section 12 through the flow conduit 13. When this lock pin 10, illustrated in FIG. 8D, is inserted into flapper seat 2 of FIG. 1, the stinger section 11 extends beyond the conical lip 7 to hold the flapper 3 in an open position. In alternative lock pin embodiments, the stinger section may have any number of flanges.

Figure 3A:
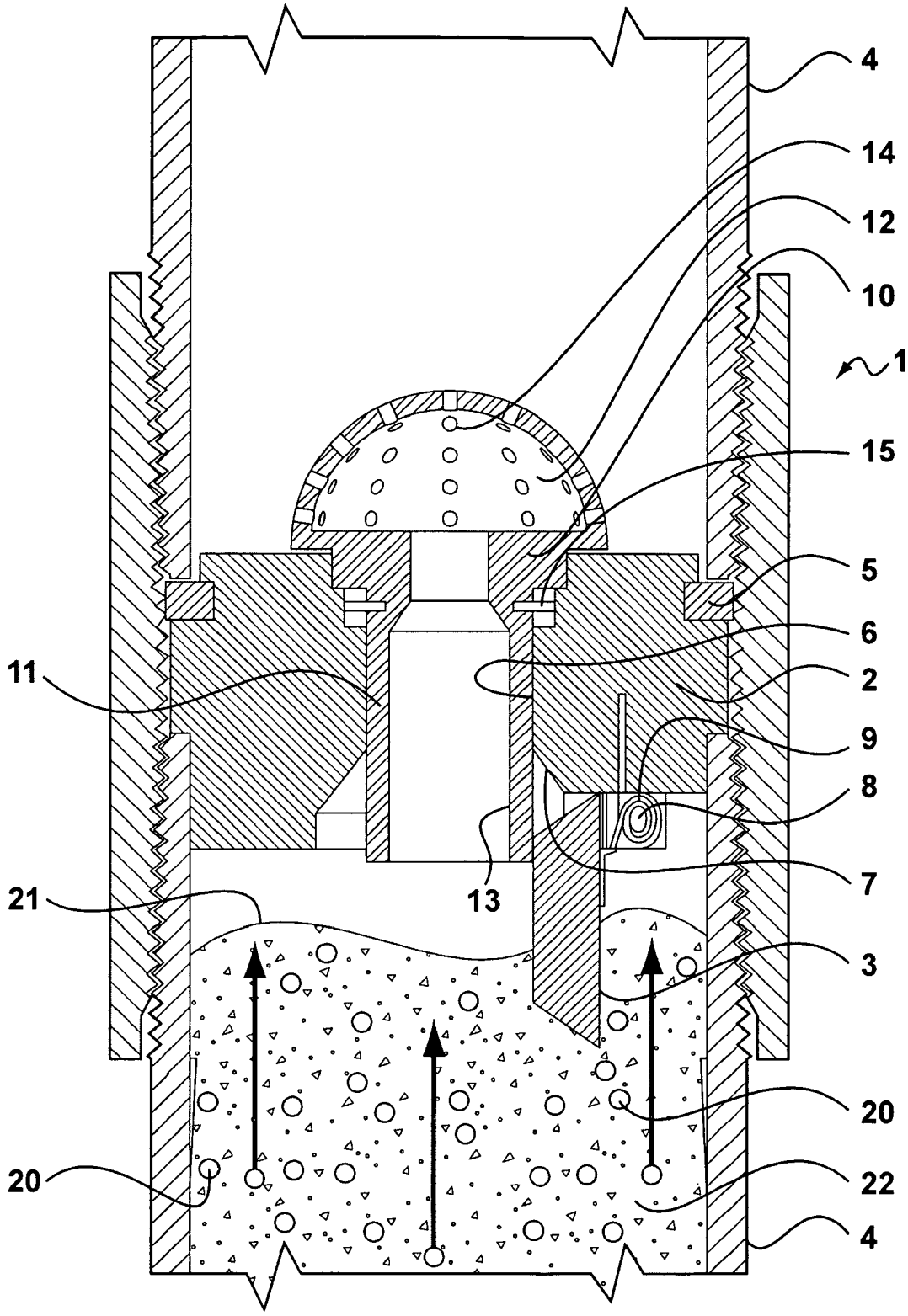
FIG. 3A is a cross-sectional, side view of a valve having a lock pin stung into a flapper seat to lock open a flapper as a cement composition and plugs flow into the valve.
Figure 3B:
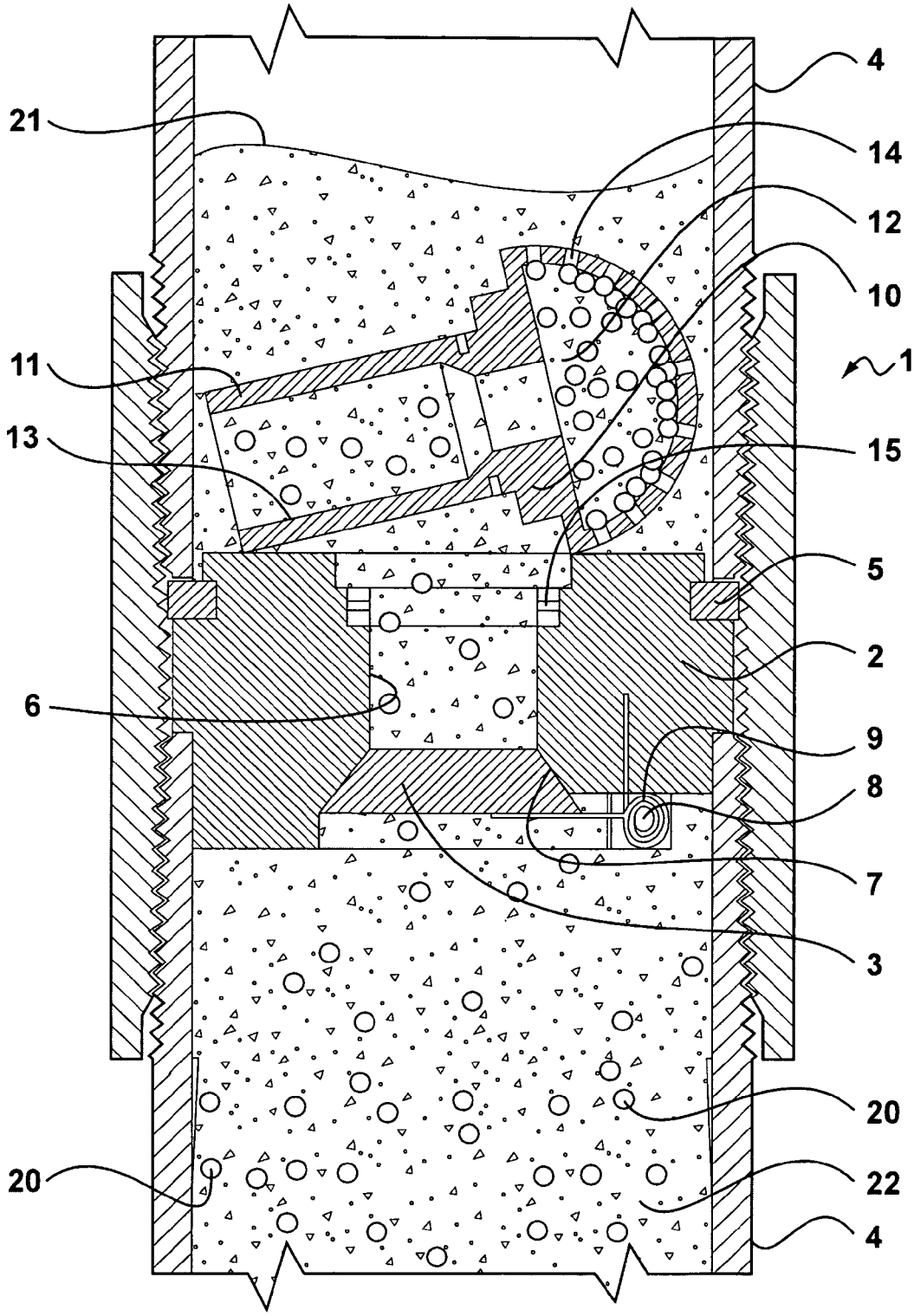
FIG. 3B is a cross-sectional, side view of the valve of FIG. 3A wherein the lock pin is pumped out of the flapper seat and the valve is closed.

FIGS. 3A and 3B illustrate cross-sectional side views of a valve similar to that illustrated in FIG. 1, wherein FIG. 3A shows the valve in a locked, open configuration and FIG. 3B shows the valve in an unlocked, closed configuration. In FIG. 3A, the lock pin 10 is stung into the flapper seat 2 so as to hold the flapper 3 in an open position. Pins 15 retain the lock pin 10 in the flapper seat 2. In FIG. 3B, the lock pin 10 is unstung from the flapper seat 2 and the flapper 3 is positioned within the conical lip 7 of the flapper seat 2 to close the valve 1.

A reverse cementing process of the present invention is described with reference to FIGS. 3A and 3B. The valve 1 is run into the wellbore in the configuration shown in FIG. 3A. With the flapper 3 held in the open position, fluid from the wellbore is allowed to flow freely up through the casing 4, wherein it passes through the flow conduit 13 of the stinger section 11 and through the holes 14 of the strainer section 12. As the casing 4 is run into the wellbore, the wellbore fluids flow through the open valve 1 to fill the inner diameter of the casing 4 above the valve 1. After the casing 4 is run into the wellbore to its target depth, a cement operation may be performed on the wellbore. In particular, a cement composition slurry may be pumped in the reverse-circulation direction, down the annulus defined between the casing 4 and the wellbore. Returns from the inner diameter of the casing 4 may be taken at the surface. The wellbore fluid enters the casing 4 at its lower end below the valve 1 illustrated in 3A and flows up through the valve 1 as the cement composition flows down the annulus.

Plugs 20 may be used to close the valve 1, when the leading edge 21 of the cement composition 22 reaches the valve 1. Plugs 20 may be inserted at the leading edge 21 of the cement composition 22 when the cement composition is injected into the annulus at the surface. As shown in FIG. 3A, the plugs 20 may be pumped at the leading edge 21 of the cement composition 22 until the leading edge 21 passes through the flow conduit 13 of the lock pin 10 of the valve 1. When the leading edge 21 of the cement composition 22 passes through strainer section 12 of the lock pin 10, the plugs 20 become trapped in the holes 14. As more and more of the plugs 20 stop fluid flow through the holes 14, the flow of the cement composition 22 becomes restricted through the valve 1. Because the cement composition 22 is being pumped down the annulus or the weight of the fluid column in the annulus generates higher fluid pressure, fluid pressure below the valve 1 increases relative to the fluid pressure in the inner diameter of the casing 4 above the valve 1. This relative pressure differential induces a driving force on the lock pin 10 tending to drive the lock pin 10 upwardly relative to the flapper seat 2. Eventually the relative pressure differential becomes great enough to overcome the retaining force of the pin or pins 15. When the pin or pins 15 fail, the lock pin 10 is released from the flapper seat 2. The released lock pin 10 is pumped upwardly in the flapper seat 2 so that the stinger section 11 no longer extends beyond the conical lip 7. FIG. 3B illustrates the configuration of the valve 1 after the stinger section 11 has been pumped out of the inner bore 6 of the flapper seat 2. Once the lock pin 10 no longer locks the flapper 3 in the open position, the spring 9 rotates the flapper 3 around the hinge 8 to a closed position in the conical lip 7 to close the valve 1. The closed valve 1 prevents the cement composition 22 from flowing up through the valve 1 into the inner diameter of the casing 4 above the valve 1.

Figure 4A:
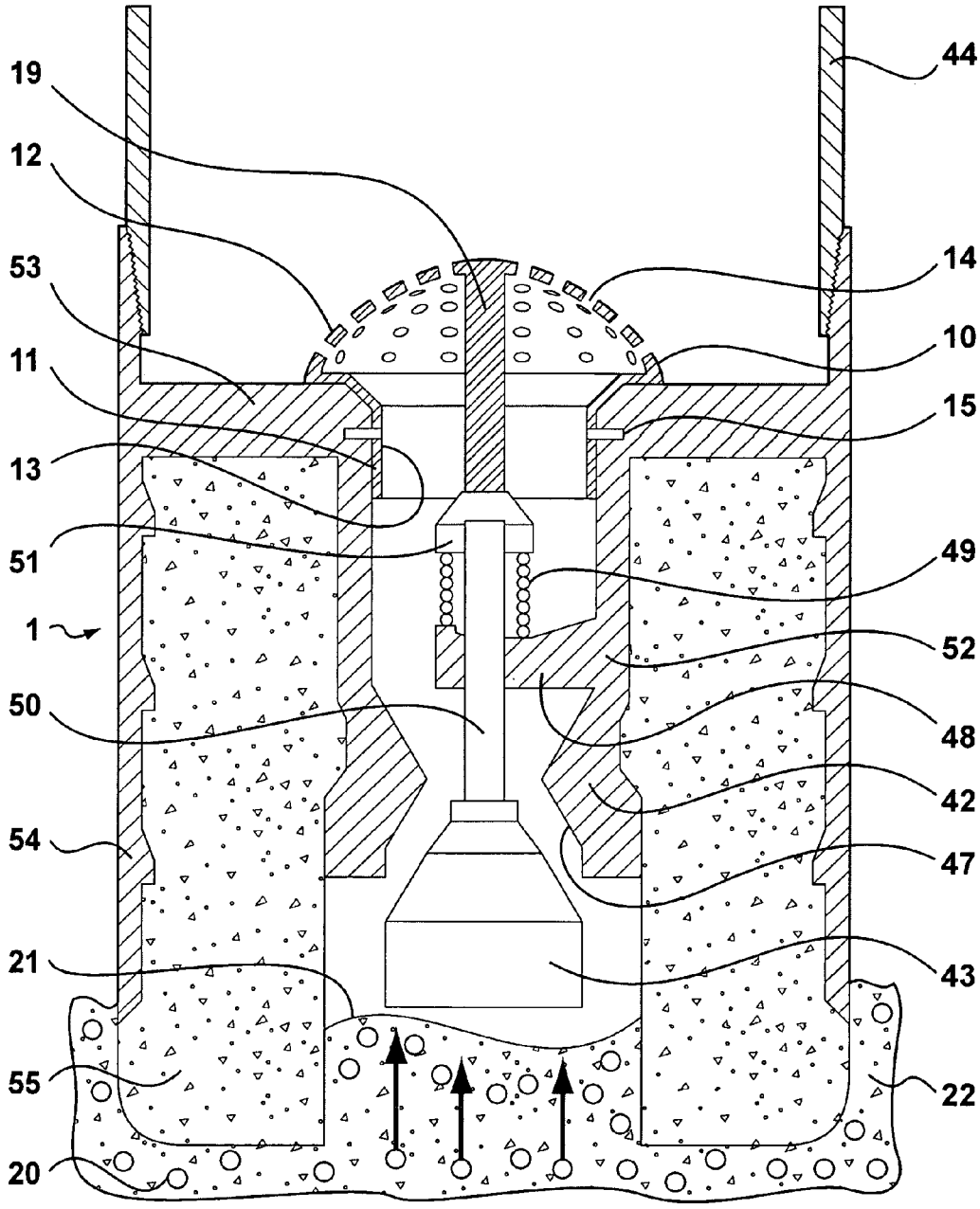
FIG. 4A is a cross-sectional, side view of a valve having a lock pin stung in into a poppet valve to lock open the poppet as a cement composition and plugs flow into the valve.
Figure 4B:
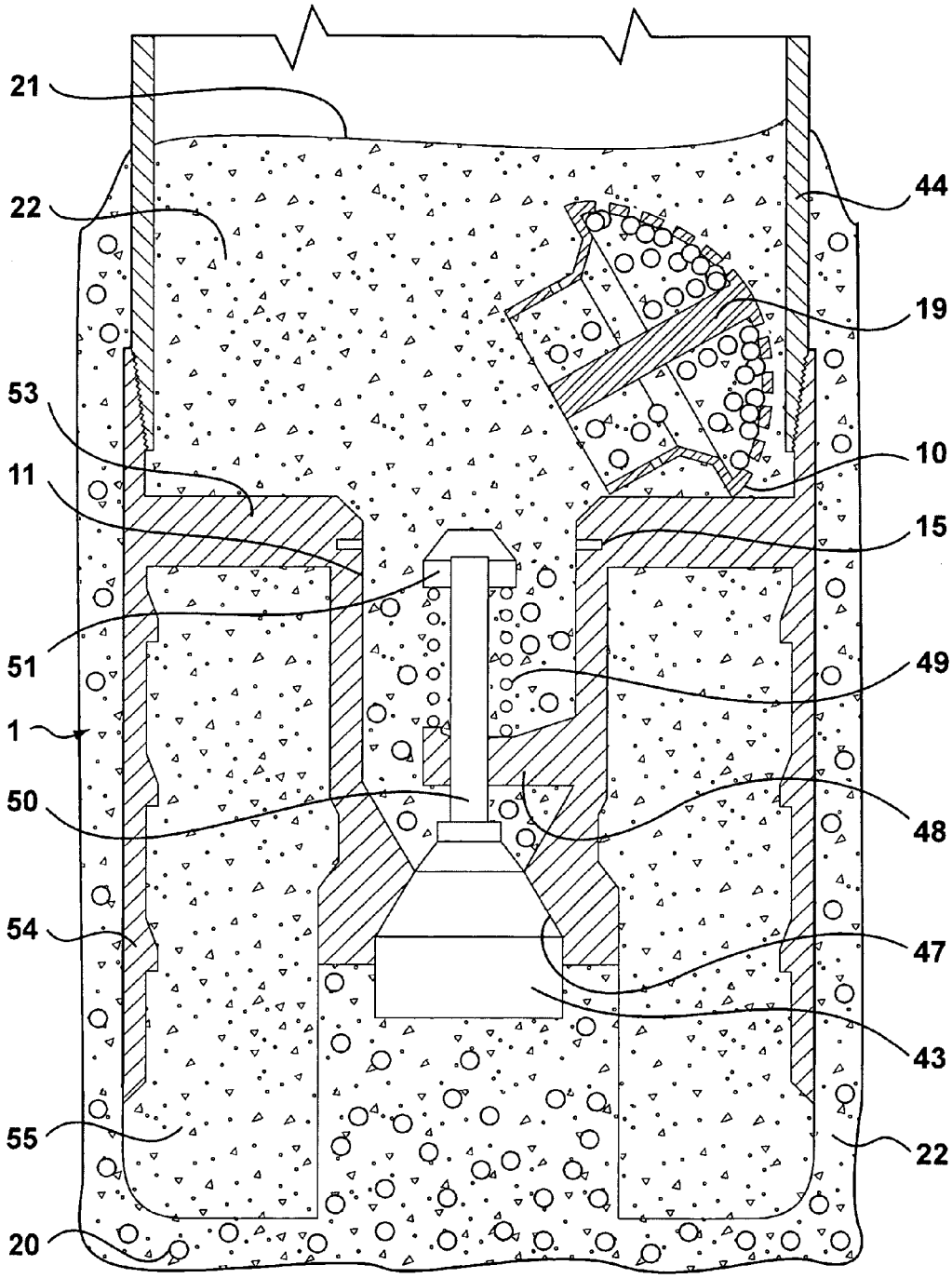
FIG. 4B is a cross-sectional, side view of the valve of FIG. 4A wherein the lock pin is pumped out of the poppet valve and the valve is closed.

Referring to FIGS. 4A and 4B, cross-sectional, side views of an alternative valve of the present invention are illustrated. In this embodiment, the valve is a poppet valve. In FIG. 4A, the poppet valve is in a locked, open configuration and in FIG. 4B, the poppet valve is in an unlocked, closed configuration.

Referring to FIG. 4A, a valve housing 52 is positioned within a valve casing 54 by a valve block 53. The valve housing 52 is further supported by cement 55 between the valve housing 52 and the valve casing 54. The valve housing 52 defines a conical lip 47 for receiving the poppet 43. A poppet holder 48 extends from the valve housing 52 into the open central portion within the valve housing 52. A poppet shaft 50 is mounted in the poppet holder 48 so as to allow the poppet shaft 50 to slide along the longitudinal central axis of the valve housing 52. The poppet 43 is attached to one end of the poppet shaft 50. A spring block 51 is attached to the opposite end of the poppet shaft 50. A spring 49 is positioned around the poppet shaft 50 between the spring block 51 and the poppet holder 48. Thus, the spring 49 exerts a force on the spring block 51 to push the spring block 51 away from the poppet holder 48, thereby pulling the poppet shaft 50 through the poppet holder 48. In so doing, the spring 49 biases the poppet 43 to a closed position in the conical lip 47.

The valve 1, illustrated in FIGS. 4A and 4B, also has a lock pin 10. In this embodiment of the invention, the lock pin 10 has a stinger section 11 and a strainer section 12. The stinger section 11 is a cylindrical structure having an outside diameter slightly smaller than the inside diameter of the valve housing 52. The stinger section 11 also has a flow conduit 13 which extends along the longitudinal direction through the stinger section 11. The strainer section 12 is connected to one open end of the stinger section 11. The strainer section 12 has a plurality of holes 14. The lock pin 10 also has a lock rod 19 that extends from the strainer section 12 along the longitudinal central axis of the lock pin 10. As shown in FIG. 4A, when the lock pin 10 is stung into the valve housing 52, the lock rod 19 presses firmly against the spring block 51. The lock pin 10 is held in the valve housing 52 by pins 15. In this position, the lock rod 19 pushes on the spring block 51 to compress the spring 19 against the poppet holder 48. Thus, when the lock pin 10 is stung into the valve housing 52, the lock pin 10 locks the poppet 43 in an open configuration.

Referring to FIG. 4B, the valve 1 is shown in an unlocked, closed configuration. The lock pin 10 is unstung from the valve housing 52. With the lock pin 10 gone from the valve housing 52, the lock rod 19 no longer presses against the spring block 51 to hold the poppet 43 in an open configuration. The spring 49 is free to work against the spring block 51 to drive the poppet shaft 51 up through the poppet holder 48 to pull the poppet 43 into engagement with the conical lip 47. Thereby, the valve 1 is closed to restrict fluid flow the wellbore up through the valve 1 into the inner diameter of the casing 44.

In an alternative embodiment, the lock pin 10 illustrated in FIGS. 8A through 8D may be used with the poppet valve 1 illustrated in FIGS. 4A and 4B. In this embodiment, because the stinger section 11 has four flanges that are joined along the longitudinal, central axis of the stinger section 11, there is no need for a lock rod 19. Rather, the distal ends of the flanges simply butt against the spring block 51 to lock the valve in an open configuration. In further alternative designs, the poppet valve is on the bottom. In still further designs, the poppet valve is on the top where the poppet moves down during flow or has a ball valve.

Similar to that previously described with reference to FIGS. 3A and 3B, a reverse circulation cementing operation may be conducted through the valve illustrated in FIGS. 4A and 4B. In particular, plugs 20 may be injected into a leading edge 21 of a cement composition 22 for circulation down an annulus while returns are taken from the inner diameter of the casing 4. As the leading edge 21 of the cement composition 22 begins to flow through the valve 1, the plugs 20 become trapped in the holes 14 of the strainer section 12 to restrict fluid flow through the lock pin 10. Increased relative pressure behind the lock pin 10 works to drive the lock pin 10 upwardly relative to the valve housing 52. Eventually, the pins 15 are no longer able to retain the lock pin 10 so that the lock pin 10 is pumped out of the valve housing 52. Thus, the plugs 20 function to unlock the valve 1, and allow the poppet 43 to moved to a closed configuration in the conical lip 47 (see FIG. 4B).

Figure 5:
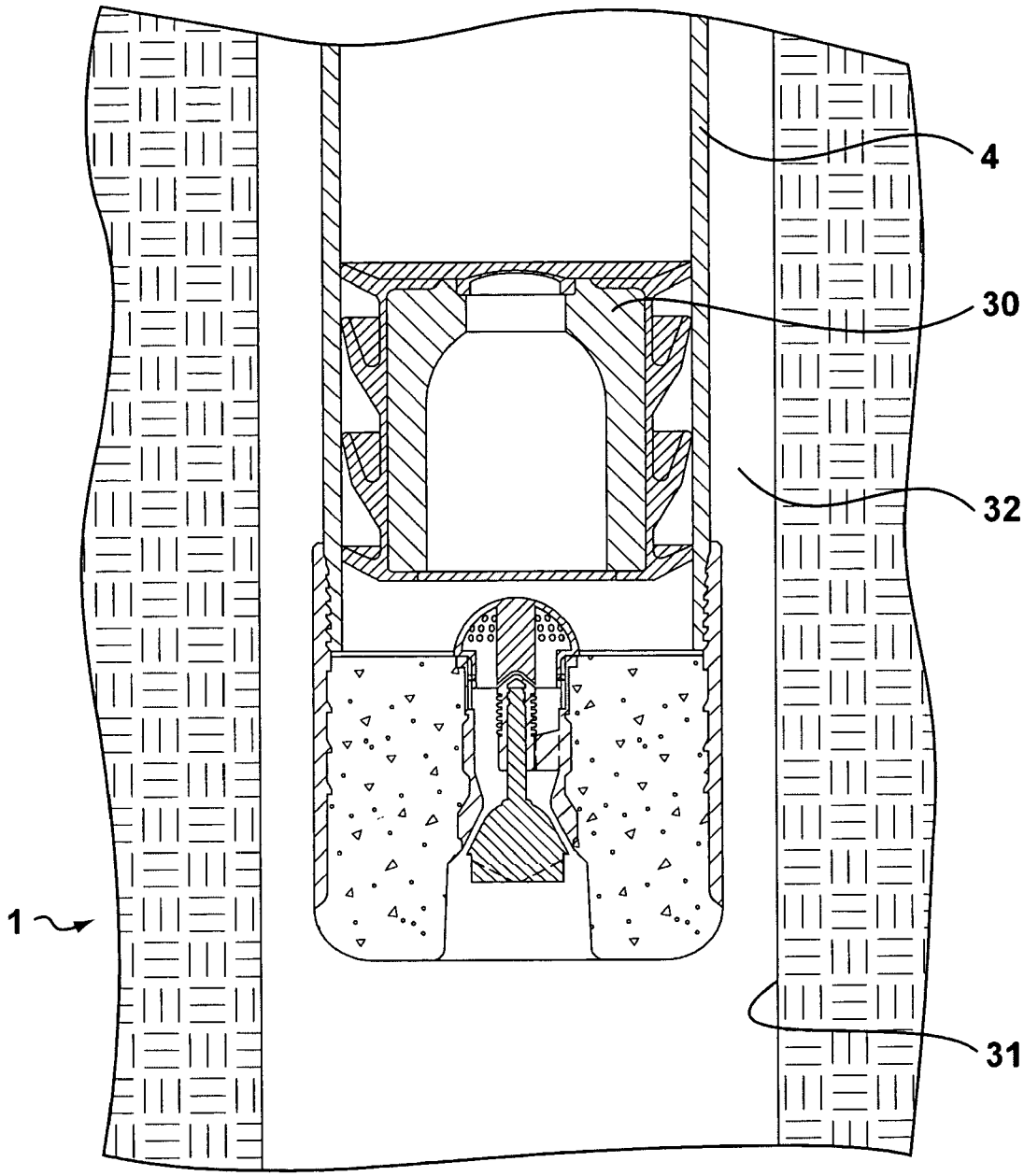
FIG. 5 is a cross-sectional side view of a valve and casing run into a wellbore, wherein a cementing plug is installed in the casing above the valve.

Referring to FIG. 5, a cross-sectional side view of a valve similar to that illustrated in FIGS. 4A and 4B is illustrated. The valve 1 and casing 4 are shown in a wellbore 31, wherein an annulus 32 is defined between the casing 4 and the wellbore 31. In this embodiment, a standard cementing plug 30 is run into the inner diameter of the casing 4 to a position immediately above the valve 1. The cementing plug 30 straddles the valve 1 and is a bottom plug pumped down as a contingency if the job was changed from a reverse cementing job to a standard job at the last minute. When a job is changed from reverse to standard, a top plug (not shown) is pumped down to land on the bottom plug. Pressure is then locked in at the top of the casing to prevent the cement from u-tubing back into the casing. In some embodiments, a top plug is pumped down to crush the mushroom head of the valve so that a bottom plug is not needed.

Figure 6A:
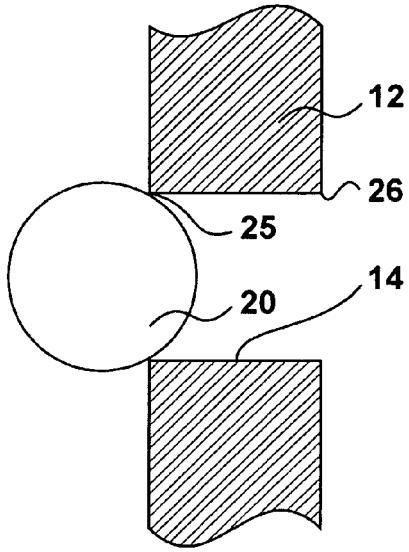
FIG. 6A is a cross-sectional, side view of a portion of a wall of a strainer section of a lock pin, wherein the wall has a cylindrical hole and a spherical plug is stuck in the hole.
Figure 6B:
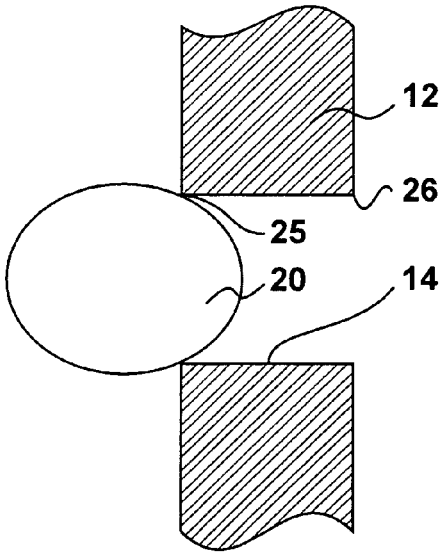
FIG. 6B is a cross-sectional, side view of a portion of a wall of a strainer section of a lock pin, wherein the wall has a cylindrical hole and an ellipsoidal plug is stuck in the hole.

FIGS. 6A and 6B illustrate cross-sectional, side views of a portion of the strainer section 12 of the lock pin 10. In particular, a hole 14 is shown extending through the wall of the strainer section 12. In this embodiment, the hole 14 is cylindrical. In FIG. 6A, the illustrated plug 20 is a sphere having an outside diameter slightly larger than the diameter of the hole 14. The plug 20 plugs the hole 14 when a portion of the plug 20 is pushed into the hole 14 as fluid flows through the hole 14. In FIG. 6B, the illustrated plug 20 is an ellipsoid wherein the greatest outside circular diameter is slightly larger than the diameter of the hole 14. The ellipsoidal plug 20 plugs the hole 14 when a portion of the plug 20 is pushed into the hole 14 as fluid flows through the hole 14.

Figure 7A:
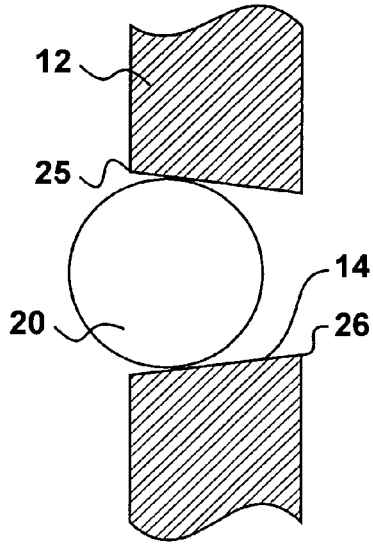
FIG. 7A is a cross-sectional, side view of a portion of a wall of a strainer section of a lock pin, wherein the wall has a conical hole and a spherical plug is stuck in the hole.
Figure 7B:
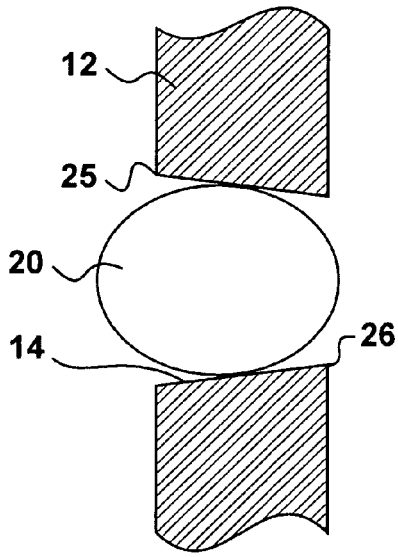
FIG. 7B is a cross-sectional, side view of a portion of a wall of a strainer section of a lock pin, wherein the wall has a conical hole and an ellipsoidal plug is stuck in the hole.

FIGS. 7A and 7B illustrate cross-sectional, side views of a portion of the strainer section 12 of the lock pin 10. In particular, a hole 14 is shown extending through the wall of the strainer section 12. In this embodiment, the hole 14 is conical. In FIG. 7A, the illustrated plug 20 is a sphere having an outside diameter slightly smaller than the diameter of the conical hole 14 at the interior surface 25 of the strainer section 12 and slightly larger than the diameter of the conical hole 14 at the exterior surface 26 of the strainer section 12. The spherical plug 20 plugs the hole 14 when at least a portion of the plug 20 is pushed into the hole 14 as fluid flows through the hole 14. In FIG. 7B, the illustrated plug 20 is an ellipsoid wherein the greatest outside circular diameter is slightly smaller than the diameter of the conical hole 14 at the interior surface 25 of the strainer section 12 and slightly larger than the diameter of the conical hole 14 at the exterior surface 26 of the strainer section 12. The ellipsoidal plug 20 plugs the conical hole 14 when at least a portion of the plug 20 is pushed into the hole 14 as fluid flows through the hole 14.

In one embodiment of the invention, the valve 1 is made, at least in part, of the same material as the casing 4, with the same outside diameter dimensions. Alternative materials such as steel, composites, iron, plastic, cement and aluminum may also be used for the valve so long as the construction is rugged to endure the run-in procedure and environmental conditions of the wellbore.

According to one embodiment of the invention, the plugs 20 have an outside diameter of between about 0.30 inches to about 0.45 inches, and preferably about 0.375 inches so that the plugs 20 may clear the annular clearance of the casing collar and wellbore (6.33 inches×5 inches for example). However, in most embodiments, the plug outside diameter is large enough to bridge the holes 14 in the strainer section 12 of the lock pin 10. The composition of the plugs may be of sufficient structural integrity so that downhole pressures and temperatures do not cause the plugs to deform and pass through the holes 14. The plugs may be constructed of plastic, rubber, steel, neoprene plastics, rubber coated steel, or any other material known to persons of skill.

Therefore, the present invention is well adapted to carry out the objects and attain the ends and advantages mentioned as well as those that are inherent therein. While the invention has been depicted and described with reference to embodiments of the invention, such a reference does not imply a limitation on the invention, and no such limitation is to be inferred. The invention is capable of considerable modification, alternation, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects.

What is claimed is:

1. A method for cementing a casing in a wellbore, the method comprising:

attaching a valve to a casing;

locking the valve in an open configuration;

running the casing and the valve into the wellbore;

reverse circulating a cement composition down an annulus defined between the casing and the wellbore;

injecting a plurality of plugs into the annulus;

unlocking the valve with the plurality of plugs; and closing the valve;

wherein locking the valve in an open configuration occurs before running the casing and valve into the wellbore.

2. The method for cementing a casing in a wellbore as claimed in claim 1, wherein the attaching a valve comprises making a flapper valve up to the casing.

3. The method for cementing a casing in a wellbore as claimed in claim 1, wherein the attaching a valve comprises making a poppet valve up to the casing.

4. The method for cementing a casing in a wellbore as claimed in claim 1, wherein the locking the valve in an open configuration comprises stinging a pin into the valve.

5. The method for cementing a casing in a wellbore as claimed in claim 1, wherein the injecting a plurality of plugs into the annulus comprises injecting the plurality of plugs at a leading edge of the cement composition.

6. The method for cementing a casing in a wellbore as claimed in claim 1, wherein the unlocking the valve with the plurality of plugs comprises trapping at least a portion of the plurality of plugs in a strainer connected to a pin stung into the valve, wherein the trapped portion of the plurality of plugs restricts fluid flow through the strainer.

7. The method for cementing a casing in a wellbore as claimed in claim 1, wherein the closing the valve comprises biasing the valve to a closed position, whereby the valve closes upon being unlocked.

8. A system for reverse-circulation cementing a casing in a wellbore, the system comprising:

a valve comprising:

a valve housing defining a valve seat;

a closure element adjustably connected to the valve housing, wherein the closure element is configurable relative to the valve seat in open and closed configurations;

a lock in mechanical communication with the closure element to lock the closure element in the open configuration when the lock is assembled in the valve housing, wherein the lock comprises a strainer with holes comprising a hole dimension; and a bias element in mechanical communication with the valve housing and the closure element, wherein the bias element biases the closure element to the closed configuration; and a plurality of plugs, wherein:

the plugs have a plug dimension larger than the hole dimension; and the plurality of plugs comprises spheres.

9. The system as claimed in claim 8, wherein the closure element comprises a flapper.

10. The system as claimed in claim 8, wherein the closure element comprises a poppet.

11. The system as claimed in claim 8, wherein the lock comprise a stinger that stings into the valve seat when the lock is assembled in the valve housing.

12. The system as claimed in claim 8, wherein the bias element comprises a spring.

13. The system as claimed in claim 8, wherein the plurality of plugs comprises spheres comprising an outside diameter between 0.30 inches to 0.45 inches.

* * * * *